US005526614A

United States Patent [19]

Huang

[11] Patent Number: 5,526,614

[45] Date of Patent: Jun. 18, 1996

[54] CONNECTOR STRUCTURE OF ASSEMBLED HOUSE TRUSS

[76] Inventor: Chun-Chi Huang, No. 151-2 Chu Wei Rd., Kang Shan Chen, Kao Hsiung Hsien, Taiwan

[21] Appl. No.: 321,907

[22] Filed: Oct. 12, 1994

[51] Int. Cl.[6] ..... E04B 1/38

[52] U.S. Cl. ..... 52/13; 52/93.1; 52/92.2; 52/655.1; 52/653.2; 52/656.9; 135/909; 403/170; 403/177; 403/178

[58] Field of Search ..... 52/93.1, 92.2, 52/13, 63, 655.1, 654.1, 653.2, 656.9, 704; 135/909; 403/170, 177, 178

[56] References Cited

U.S. PATENT DOCUMENTS

| | | | |
|---|---|---|---|
| 657,987 | 9/1900 | Kramer | 52/13 |
| 1,022,948 | 4/1912 | Jacobs | 52/13 |
| 1,129,462 | 2/1915 | Foley | 52/93.1 |
| 2,001,215 | 5/1935 | Ruppel | 52/93.1 X |
| 2,658,776 | 11/1953 | Wilcox | 52/653.2 |
| 2,839,320 | 6/1958 | Hill | 135/909 X |
| 2,840,400 | 6/1958 | D'Azzo | 52/63 X |
| 3,424,178 | 1/1969 | Yazaki | 135/909 X |
| 5,240,058 | 8/1993 | Ward | 52/63 X |
| 5,326,337 | 7/1994 | Pardella | 403/170 X |

*Primary Examiner*—Robert J. Canfield
*Attorney, Agent, or Firm*—Bacon & Thomas

[57] ABSTRACT

A connector structure of assembled house truss is disclosed. The respective support members of the house truss are inserted and fixed in the connector by screws so that the support members can be quickly and easily assembled by a general person to form the house truss without welding operation and using any power.

1 Claim, 9 Drawing Sheets

CONNECTOR STRUCTURE OF ASSEMBLED HOUSE TRUSS

BACKGROUND OF THE INVENTION

The present invention relates to a connector structure of assembled house truss, and more particularly to a connector which enables the support members of the house truss to be quickly assembled into the house truss without using any power.

As shown in FIG. 1, a conventional house truss is formed by connecting multiple support members with one another in a welding manner. Several shortcomings exist in such structure as follows:

1. The welding procedure must be accomplished by an expert so as to establish a concrete house truss. Therefore, a general person is unable to perform the truss assembling procedure by himself/herself and the cost for labor in the truss assembling procedure cannot be saved.

2. The welding operation necessitates a power source so that in a remote place such as a garden or a field without any power source, the assembling procedure cannot be performed.

It is therefore necessary to provide a connector structure of the assembled house truss which enables the support members of the house truss to be quickly assembled into the house truss without welding operation.

SUMMARY OF THE INVENTION

It is therefore a primary object of the present invention to provide a connector structure of assembled house truss to substitute the conventional welding measure for constructing a house truss so that the support members of the house truss can be easily and quickly assembled by a general person without any expertise. Consequently, the manufacturing cost for the house truss can be considerably reduced.

It is a further object of the present invention to provide the above connector structure which is used to connect the respective support members of the house truss with one another without welding so that no power source is necessary in the assembling procedure and the danger in the welding operation can be eliminated.

It is still a further object of the present invention to provide the above connector structure which permits the support members of the house truss to be easily and quickly disassembled. Therefore, the disassembling procedure can be performed without incurring excessively high second cost.

The present invention can be best understood through the following description and accompanying drawing, wherein:

DETAILED DESCRIPTION OF THE PREFERRED EMBODIMENTS

Figure 1B:
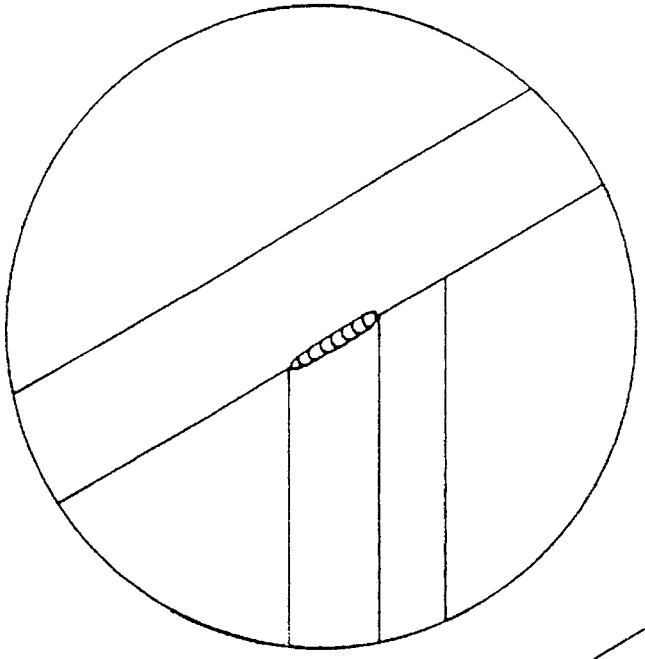
FIG 1 B PRIOR ART
FIG. 1B is an enlarged view of area A in FIG. 1A.
Figure 1A:
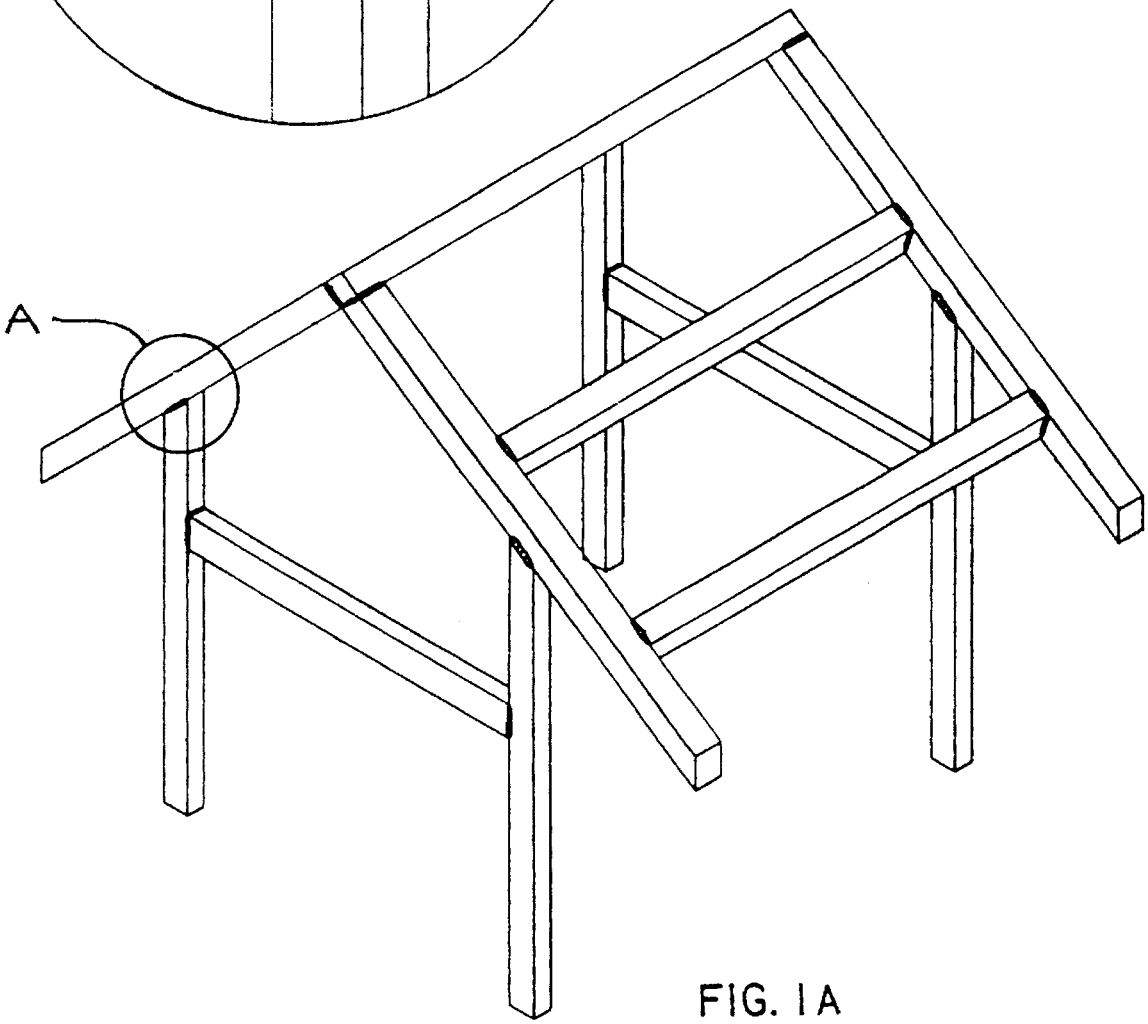
FIG. 1A PRIOR ART
FIG. 1 is a perspective view of a conventional house truss.
Figure 2:
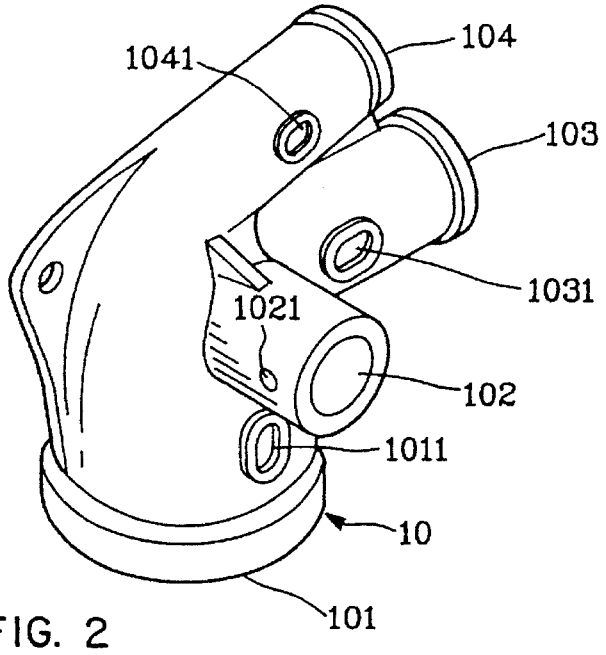
FIG. 2 shows the first connector of the present invention.
Figure 3:
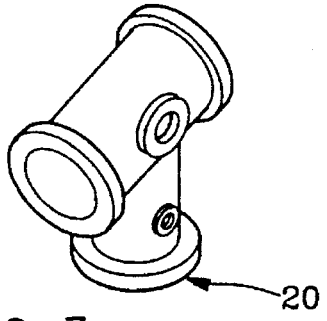
FIG. 3 shows the second connector of the present invention.
Figure 4:
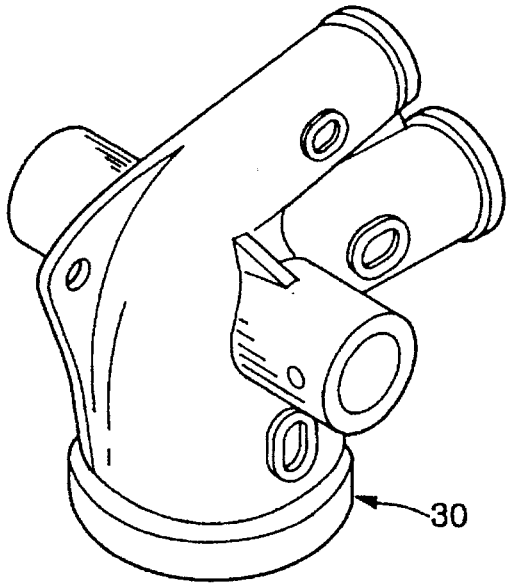
FIG. 4 shows the third connector of the present invention.
Figure 5:
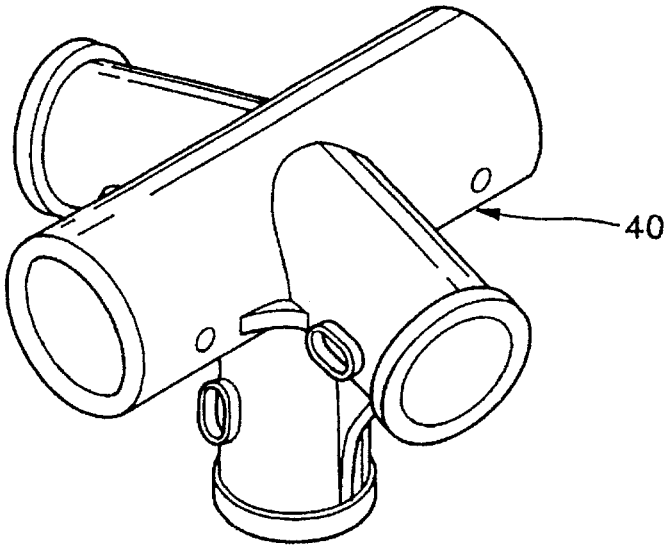
FIG. 5 shows the fourth connector of the present invention.
Figure 6:
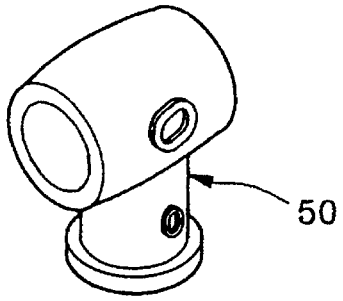
FIG. 6 shows the fifth connector of the present invention.
Figure 7:
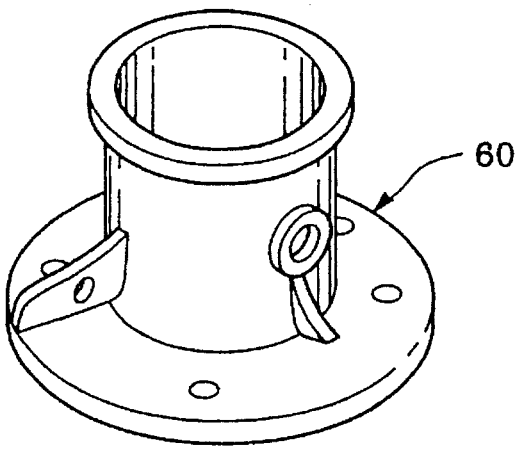
FIG. 7 shows the sixth connector of the present invention.
Figure 8:
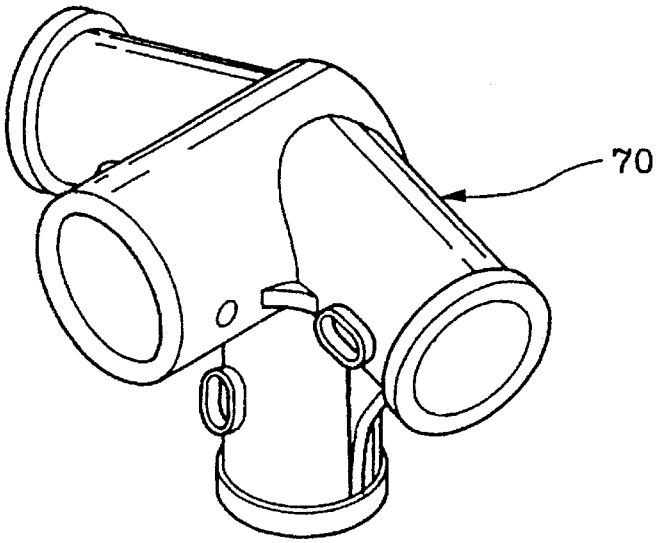
FIG. 8 shows the seventh connector of the present invention.
Figure 9:
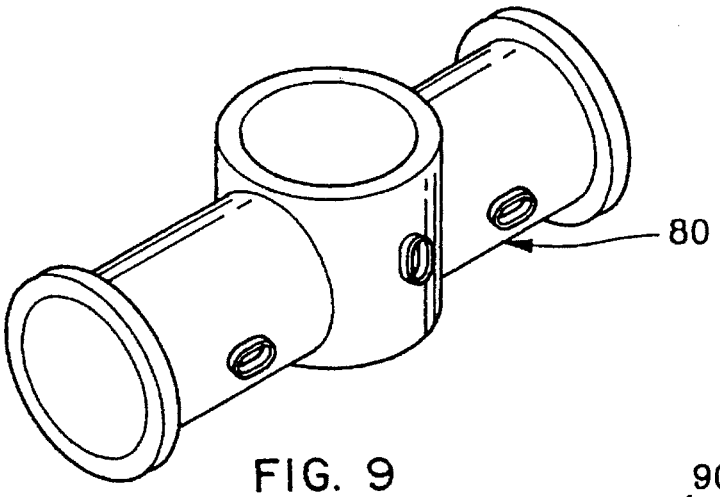
FIG. 9 shows the eighth connector of the present invention.
Figure 10:
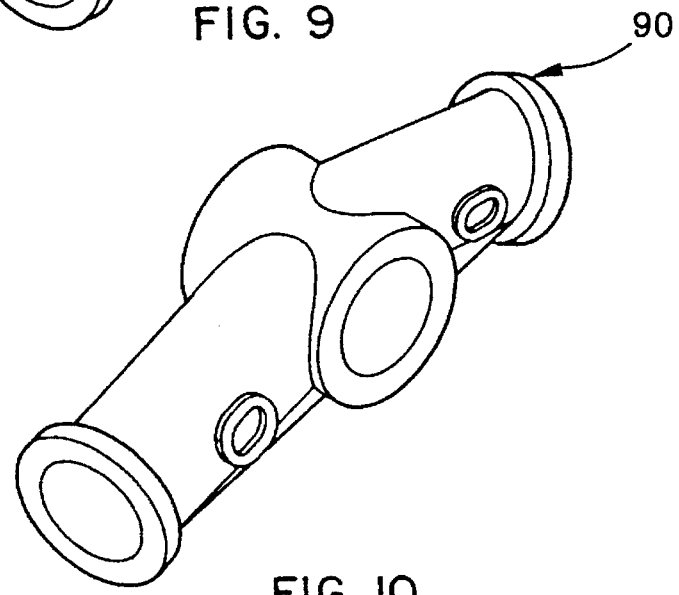
FIG. 10 shows the ninth connector of the present invention.
Figure 11:
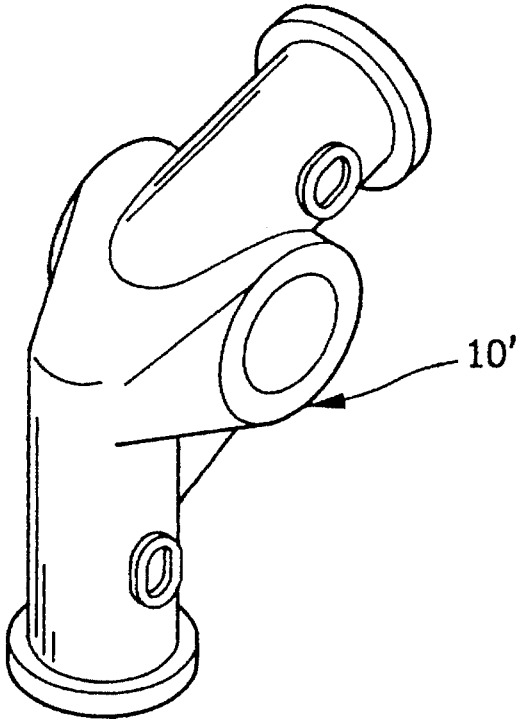
FIG. 11 shows the tenth connector of the present invention.
Figure 12:
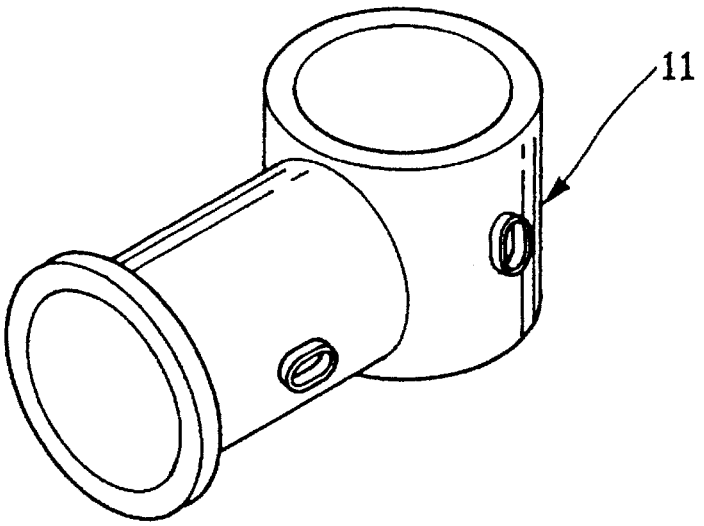
FIG. 12 shows the eleventh connector of the present invention.

Please first refer to FIG. 2 which shows a first connector 10 including a first, a second, a third and a fourth connecting tubes 101, 102, 103 and 104 each of which is formed with thread holes 1011, 1021, 1031 and 1041 on two lateral sides. The first, second and third connecting tubes 101, 102 and 103 are perpendicular to one another while the fourth connecting tube 104 and the third connecting tube 103 contain a certain angle. The connector 10 is disposed at each of the four upper corners of the house truss. FIG. 3 shows a second connector 20 which has three connecting tubes for connecting the slant members of the roof truss. FIG. 4 shows a third connector 30 which has five connecting tubes and is used for supporting the house truss upright. FIG. 5 shows a fourth connector 40 having five connecting tubes and disposed at the ridge of the house truss. FIG. 6 shows a fifth connector 50 having three connecting tubes and used to connect the upright members and prevent the same from tilting and collapsing. FIG. 7 shows a sixth connector 60 which is cap-like and used as a base support of the house truss. FIG. 8 shows a seventh connector 70 which has four connecting tubes and disposed on an outer end of the ridge. FIG. 9 shows an eighth connector 80 which reinforces the upright support member A of the house truss. FIG. 10 shows a ninth connector 90 which has four connecting tubes and is used at the ridge. FIG. 11 shows a tenth connector 10' which has four connecting tubes and is used to connect the roof and the lateral wall of the house truss. FIG. 12 shows an eleventh connector 11 which has three connecting tubes and is used to connect the lateral reinforcing member with the upright support member of the house truss. Each of the above connectors is connected with the connecting members or support members by means of screws without welding.

Figure 13:
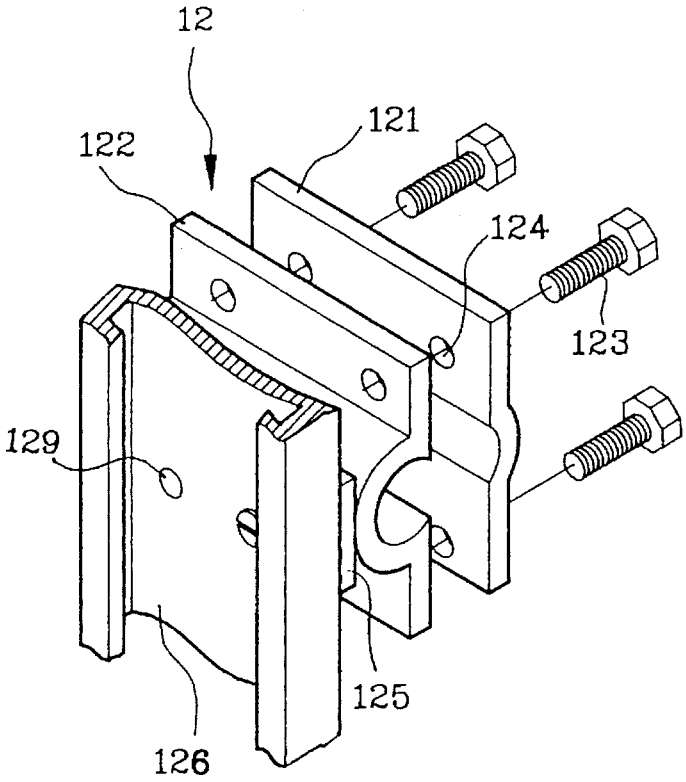
FIG. 13 shows the twelfth connector of the present invention.
Figure 14:
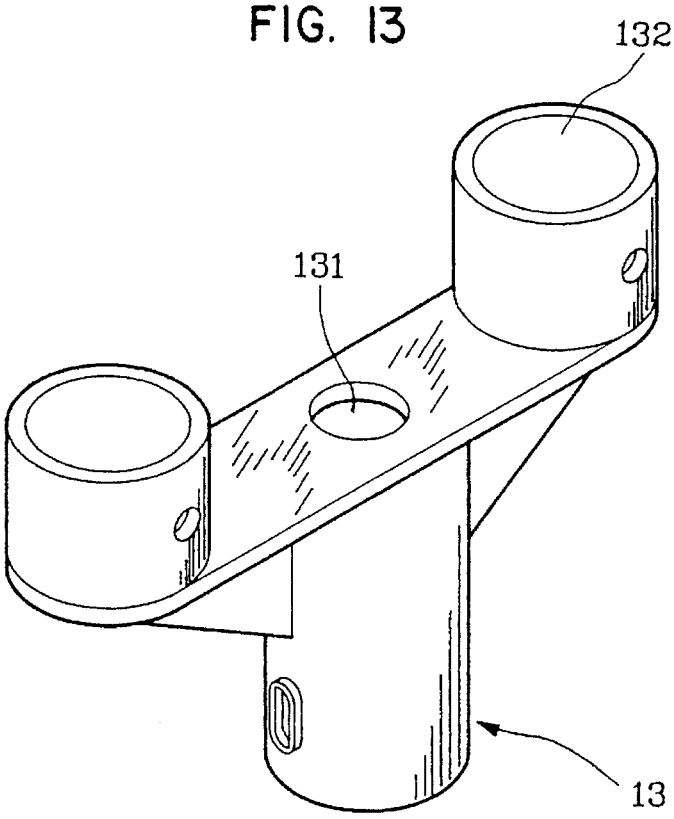
FIG. 14 shows the thirteenth connector of the present invention.
Figure 15:
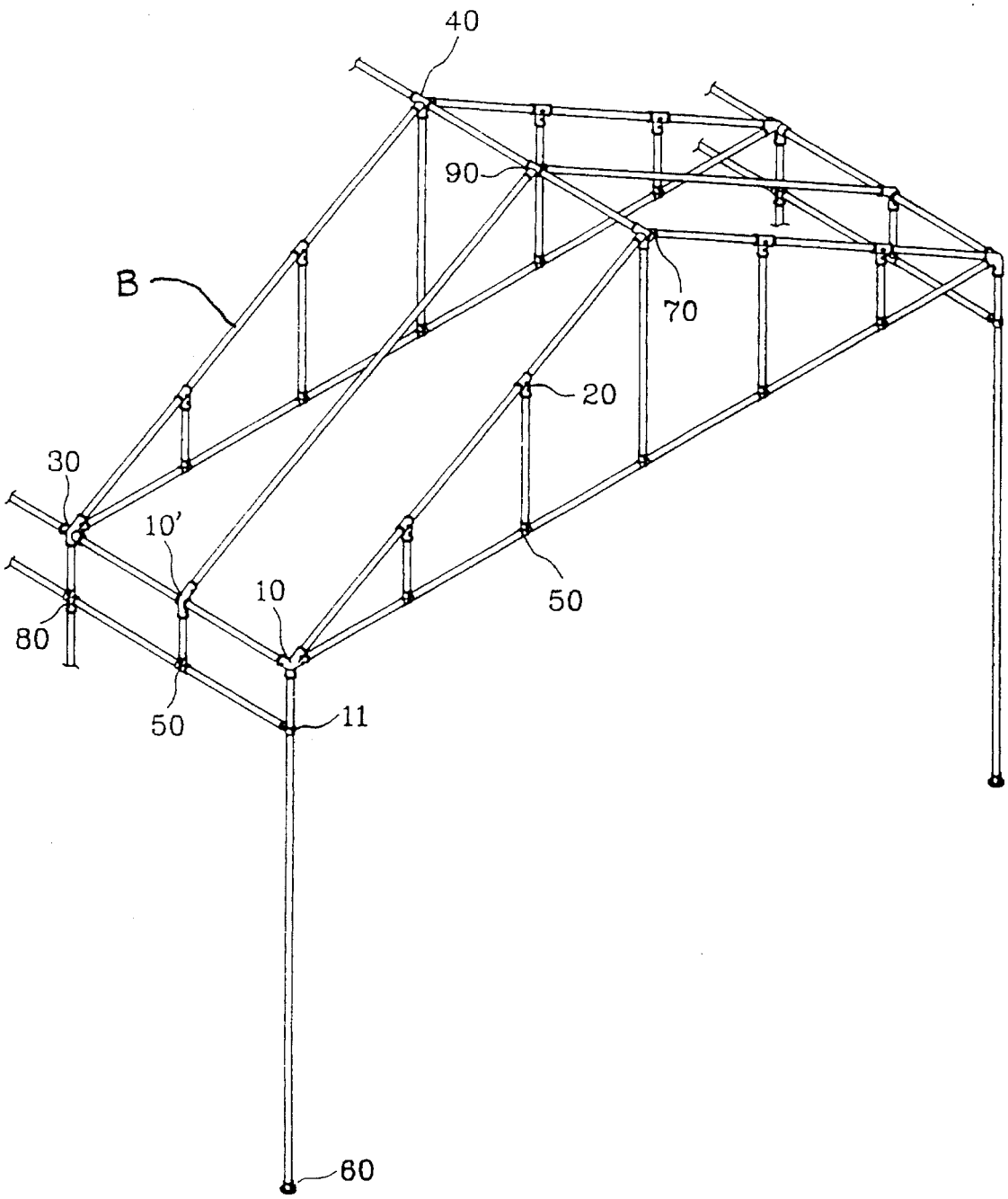
FIG. 15 is a perspective view of the house truss constructed by means of the connectors of the present invention.
Figure 16:
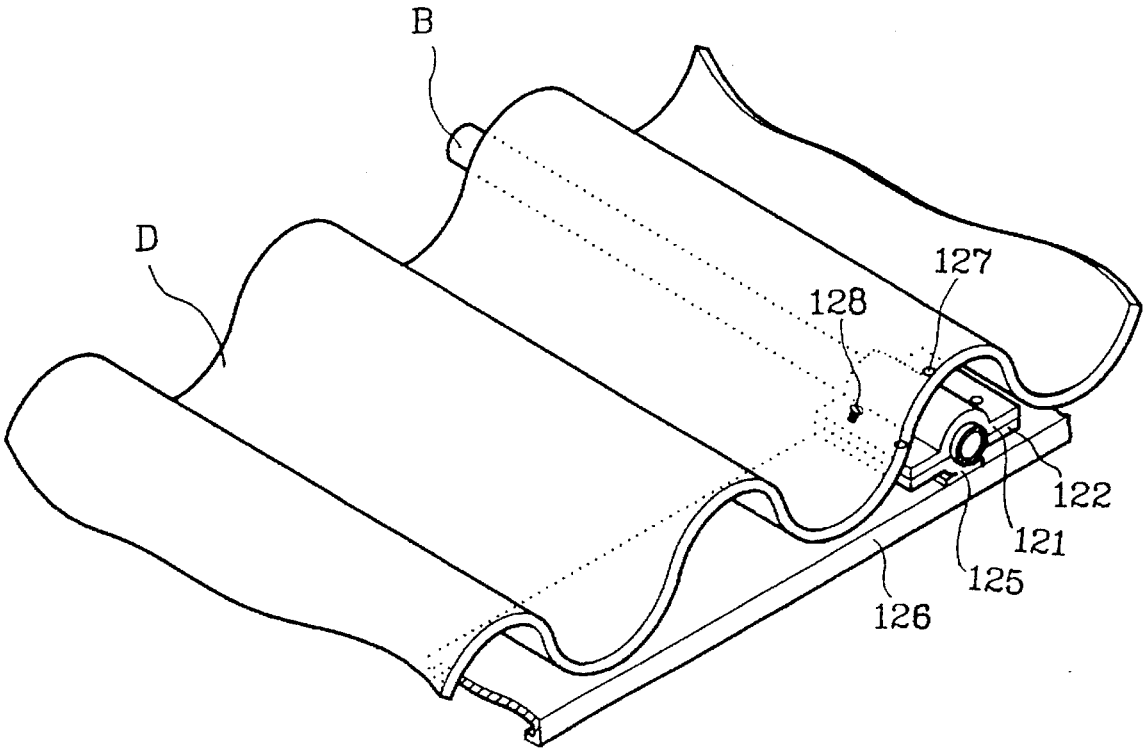
FIG. 16 shows that the pantile is connected with the twelfth connector of the present invention to form a cover of the house truss.
Figure 17B:
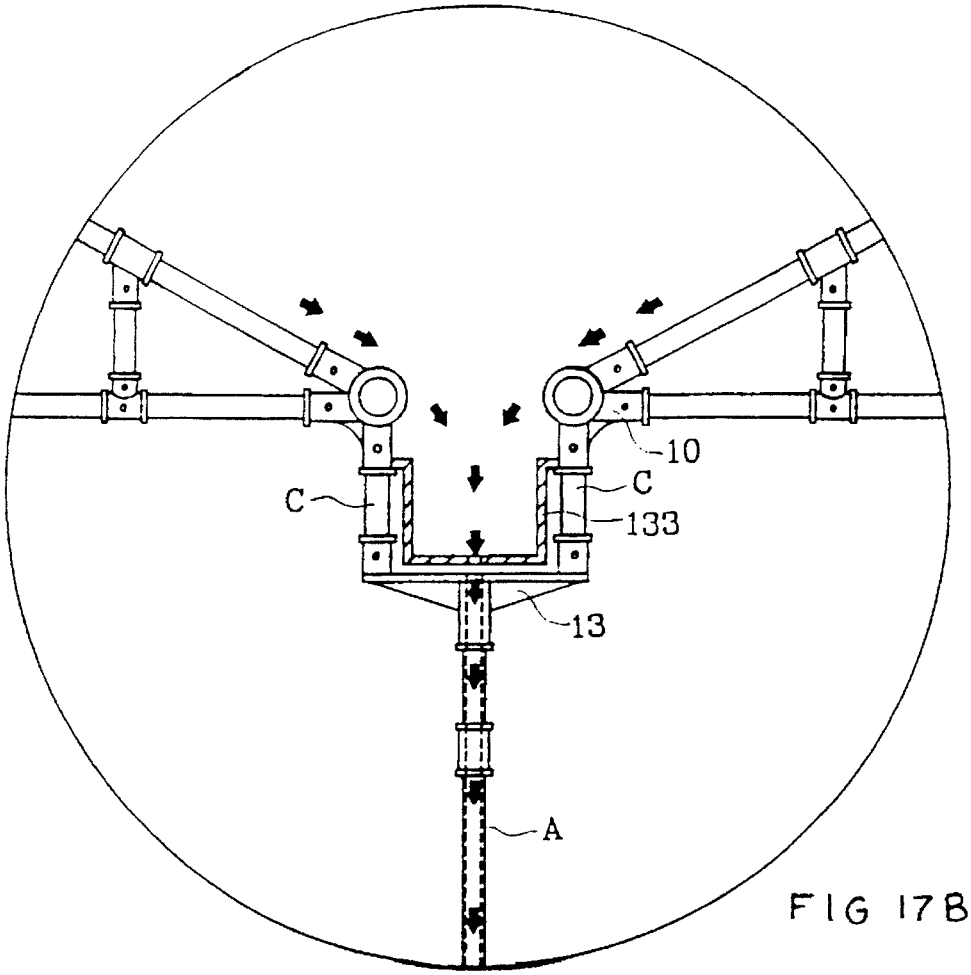
FIG. 17B is an enlarged view of area D in FIG. 17A.
Figure 17A:
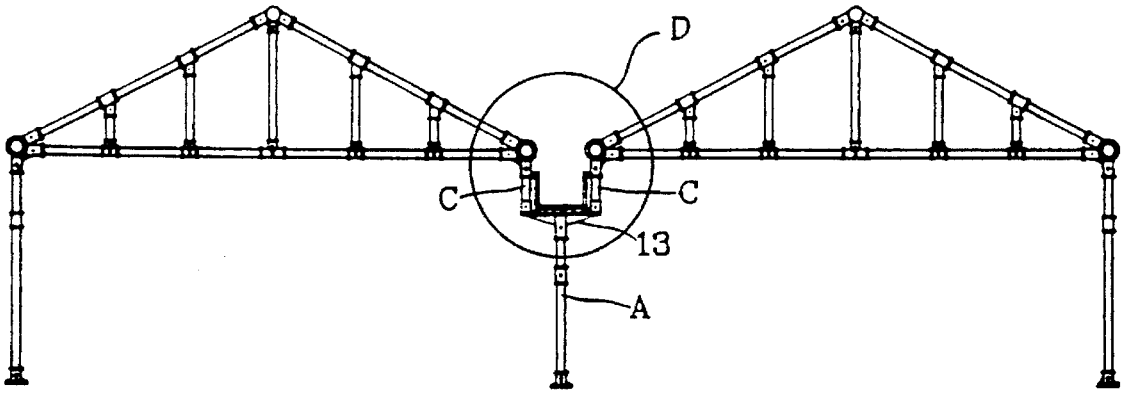
FIG. 17A shows that the thirteenth connector of the present invention is used to connect two adjacent house trusses in series and form a draining passage.

When the roof of the house truss is covered by a pantile, a metal board, a heat-insulating board or other suitable articles, a twelfth connector 12 as shown in FIG. 13 is used in a manner as shown in FIG. 16. The twelfth connector 12 includes a first and a second arch tube-clamping plates 121, 122 formed with thread holes 124 for the screws 123 to pass therethrough so as to clamp the support member B of the roof. The second clamping plate 122 is disposed with a support face 125 which extends from the middle section of the arch portion of the clamping plate 122 and is formed with thread holes 127, whereby the screws 128 can be screwed into the thread holes 127 and the thread holes 129 of a C-shaped steel beam 126 so as to place and fix the shading member D of pantile, metal board, heat-insulating board or other suitable materials on the steel beam 126 by screws. On the other hand, when two house trusses are connected in series, a thirteenth connector 13 as shown in FIG. 14 can be used in a manner shown by FIGS. 17A and 17B. The thirteenth connector 13 has two lateral connecting tubes 132 and a middle connecting tube 131, wherein the lateral connecting tubes 132 are connected with the vertical connecting tubes of the first connector 10 and the third connecting tube 30 of the adjacent house trusses and associated with a draining channel 133. The draining channel 133 is connected with the opening of the middle connecting tube 131 for draining rain water. The thirteenth connector 13 can be disposed at four corners of each of the house trusses or on the lateral middle upright support members A thereof. Two auxiliary support members C are further connected with the connector 13 for connecting with the first connector 10 and third connector 30 of the adjacent house trusses.

According to the above description, the present invention has the advantages as follows:

1. The assembling and disassembling procedures can be quickly performed. The respective support members can be quickly assembled into a house truss with desired specification and concrete structure by means of the above respective connectors. When it is desired to disassemble the house truss, the support members can be quickly departed from one another without excessively high second cost.

2. The cost is reduced. Because the support members are connected with one another without welding, the assembling procedure can be quickly accomplished by a general person without expertise. Therefore, the labor cost can be saved.

3. The installation and working site are not limited by the power source. Because the house truss is assembled without welding, the assembling procedure can be performed in any place without the limitation of the power source. Therefore, the problem of the conventional device that the assembling procedure cannot be performed in a remote place such a farm or a field where no power source is available.

It is to be understood that the above description and drawings are only used for illustrating one embodiment of the present invention, not intended to limit the scope thereof. Any variation and derivation from the above description and drawings should be included in the scope of the present invention.

What is claimed is:

1. A house truss assembly comprising: a plurality of tubular support members; a plurality of first connectors each including a first, a second, a third and a fourth connecting tube each of which is formed with thread holes on two lateral sides, said first, second and third connecting tubes being perpendicular to one another while the fourth connecting tube and the third connecting tube form a predetermined outer angle, said first connectors being mounted on support members forming corners of a house truss by the first connector tubes; a plurality of second connectors each having three connecting tubes said second connectors connecting with support members forming a slanted roof of a house truss; a plurality of third connectors each having five connecting tubes each connected to a support member for supporting a house truss upright; a plurality of four connectors each having five connecting tubes said fourth connectors connected to support members forming a ridge of a house truss; a plurality of fifth connectors each having three connecting tubes said fifth connectors connected to upright support members to prevent tilting and collapsing; a plurality of sixth connectors which are connected to support members to form a base support of a house truss; a plurality of seventh connectors each of which has four connecting tubes said seventh connectors connected to support members to form an outer end of the ridge; a plurality of eighth connectors each of which is connected to support members to reinforce an upright support member of a house truss; a plurality of ninth connectors, each of which has four connecting tubes connected to support members at the ridge; a plurality of tenth connectors, each of which has four connecting tubes connected to support members so as to connect a roof and a lateral wall of the house truss; a plurality of eleven connectors, each of which has three connecting tubes connected to support members so as to connect lateral reinforcing support members of a house truss with an upright support member of the house truss; a plurality of twelfth connectors including a first and a second arch-shaped tube-clamping plates formed with holes for screws to pass therethrough so as to clamp onto support members forming the roof, said second clamping plate being disposed with a support face which extends from a middle section of an arch portion of said second clamping plate and is formed with thread holes to be fixed on a steel beam which supports a cover member to form the roof of a house truss by screws; and a plurality of thirteenth connectors each of which has two laterally displaced connecting tubes and a middle connecting tube, wherein said lateral connecting tubes are connected with vertically extending support members connected to one said first connector of two adjacent house trusses; and a draining channel connected with an opening of said middle connecting tube for draining rain water.

* * * * *